US005822807A

United States Patent [19]

Gallagher et al.

[11] Patent Number: 5,822,807

[45] Date of Patent: Oct. 20, 1998

[54] SUCTION RELIEF APPARATUS

[76] Inventors: Patrick J. Gallagher, 1808 Viking Blvd. N.W., Cedar, Minn. 55011; Larry R. Mills, 27737 104th St., Zimmerman, Minn. 55398

[21] Appl. No.: 824,062

[22] Filed: Mar. 24, 1997

[51] Int. Cl.[6] ..... E04H 4/12

[52] U.S. Cl. ..... 4/507; 4/509; 4/541.2; 137/526; 137/907

[58] Field of Search ..... 4/541.1–541.3, 4/504, 507, 509, 492, 541.4, 541.5; 417/17, 44.2, 44.3; 137/462, 505.11, 513.7, 526, 535, 537, 907; 251/51, 57

[56] References Cited

U.S. PATENT DOCUMENTS

| | | | |
|---|---|---|---|
| 2,590,918 | 4/1952 | Barnes | 137/462 |
| 3,801,992 | 4/1974 | Sable | 4/509 |
| 4,115,878 | 9/1978 | Johnson et al. | 4/509 |
| 4,620,835 | 11/1986 | Bell | 417/14 |
| 5,167,041 | 12/1992 | Burkitt, III | 4/509 |
| 5,351,709 | 10/1994 | Vos | 137/907 |
| 5,570,481 | 11/1996 | Mathis et al. | 4/504 |
| 5,682,624 | 11/1997 | Ciochetti | 4/509 |
| 5,725,359 | 3/1998 | Dongo et al. | 417/44.2 |

*Primary Examiner*—Charles R. Eloshway
*Attorney, Agent, or Firm*—Faegre & Benson

[57] ABSTRACT

A suction relief apparatus for relieving suction at a suction connection of a swimming pool or spa having a main valve member movable from an open to a closed position to relieve suction at the suction connection in the event of a blockage of the suction connection in the pool. The main valve remains closed until a reset valve is opened, at which time a spring returns the main valve to the open condition, enabling suction to resume at the suction connection of the pool. A switch responsive to increased suction indicative of an obstruction may be utilized to deactivate a suction pump motor. In an alternative embodiment, a frangible member may replace the main valve and reset valves to open a connection to ambient air atmosphere in the event of increased suction in the suction line resulting from an obstruction at the suction connection in the pool.

9 Claims, 8 Drawing Sheets

SUCTION RELIEF APPARATUS

BACKGROUND OF THE INVENTION

This invention relates to the field of equipment for swimming pools and spas, more particularly, to a relief valve for the suction connection for recirculating water in the pool or spa. In the past, injury or death by drowning has been a possibility for swimmers or bathers held against the unrelieved suction at the suction connection in the pool or spa by continued operation of the recirculating water loop. The present invention overcomes the disadvantages of the prior art by providing a suction relief apparatus which relieves suction at the suction connection in the event of an obstruction thereat. As used herein, "pool" is to be understood to mean swimming pool, spa, whirlpool bath, or any other similar recreational or therapeutic water reservoir. Also as used herein the term "fluid" is to be understood to include liquids and gases.

DETAILED DESCRIPTION OF THE INVENTION

Figure 1:
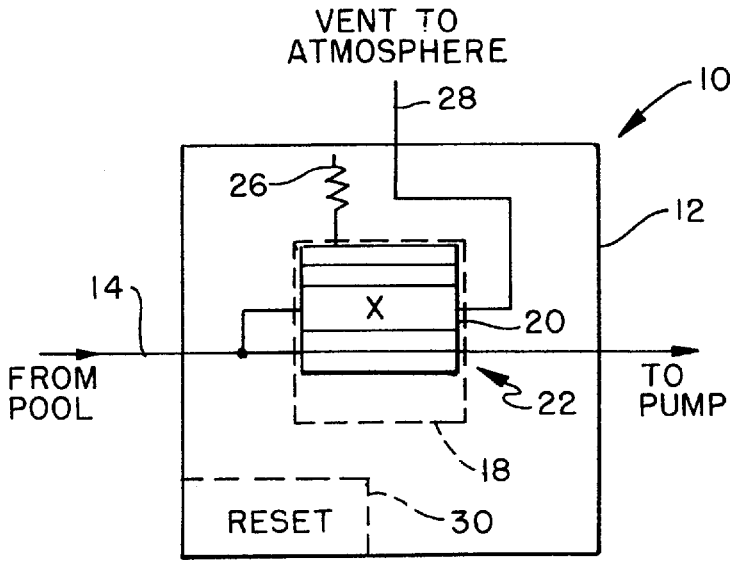
FIG. 1 is a simple block diagram of a suction relief valve apparatus useful in the practice of the present invention shown in a NORMAL suction state.
Figure 2:
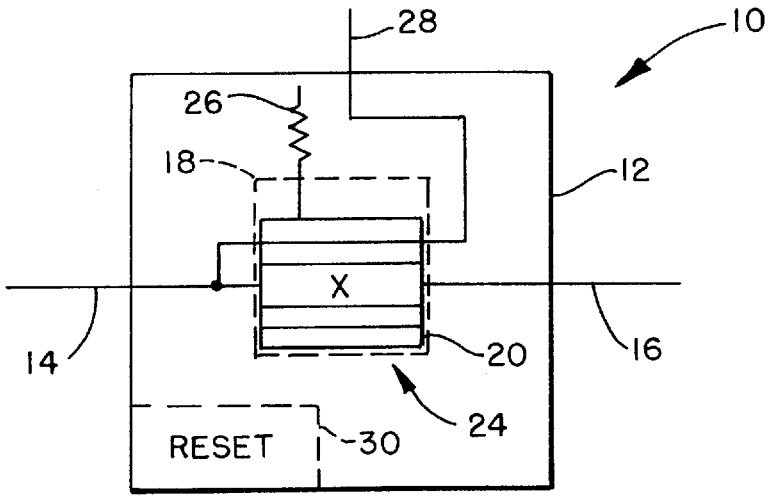
FIG. 2 is a view of the block diagram of FIG. 1 with the apparatus shown in the INLET BLOCKED state.

Referring to the Figures, and most particularly to FIGS. 1 and 2, a simplified block diagram of a suction relief valve 10 useful in the practice of the present invention may be seen. Valve 10 preferably has a main valve housing 12, an inlet port 14, an outlet port 16, and an actuator chamber 18 in fluid communication with and located between the inlet port 14 and the outlet port 16. Valve 10 also includes a main valve actuator member 20 in the chamber 18 and movable between a first position 22 (shown in FIG. 1) permitting fluid communication between the inlet port 14 and the outlet port 16 and a second position 24 (shown in FIG. 2) wherein the actuator member 20 blocks fluid communication between the ports 14 and 16. A biasing means or spring 26 is connected between the housing 12 and the actuator member 20 to urge the actuator member to the first position 22 in the absence of a pressure differential between the ports 14 and 16. The actuator member 20 moves to the second position 24 in response to an increase in the pressure differential between ports 14 and 16 that occurs when an obstruction is present upstream of the inlet port 14. Such an obstruction may be a bather or swimmer in a spa or pool to which the valve 10 is connected. In such circumstances, it is highly desirable to break suction to avoid injury or even drowning of a person who might otherwise be trapped against a suction connection in the pool by the uninterrupted suction of the recirculating water pump.

Valve 10 also includes a vent port 28 in fluid communication with the actuator chamber 18. Vent port 28 is selectively connectable for fluid communication with the inlet port 14 when the actuator member 20 is in the second position, thus venting the inlet port to ambient atmospheric pressure when the valve senses an obstruction at the suction connection. Valve 10 also has a reset valve 30 to restore the valve 10 from the condition shown in FIG. 2 to the condition shown in FIG. 1, as will be explained in more detail below.

Figure 3:
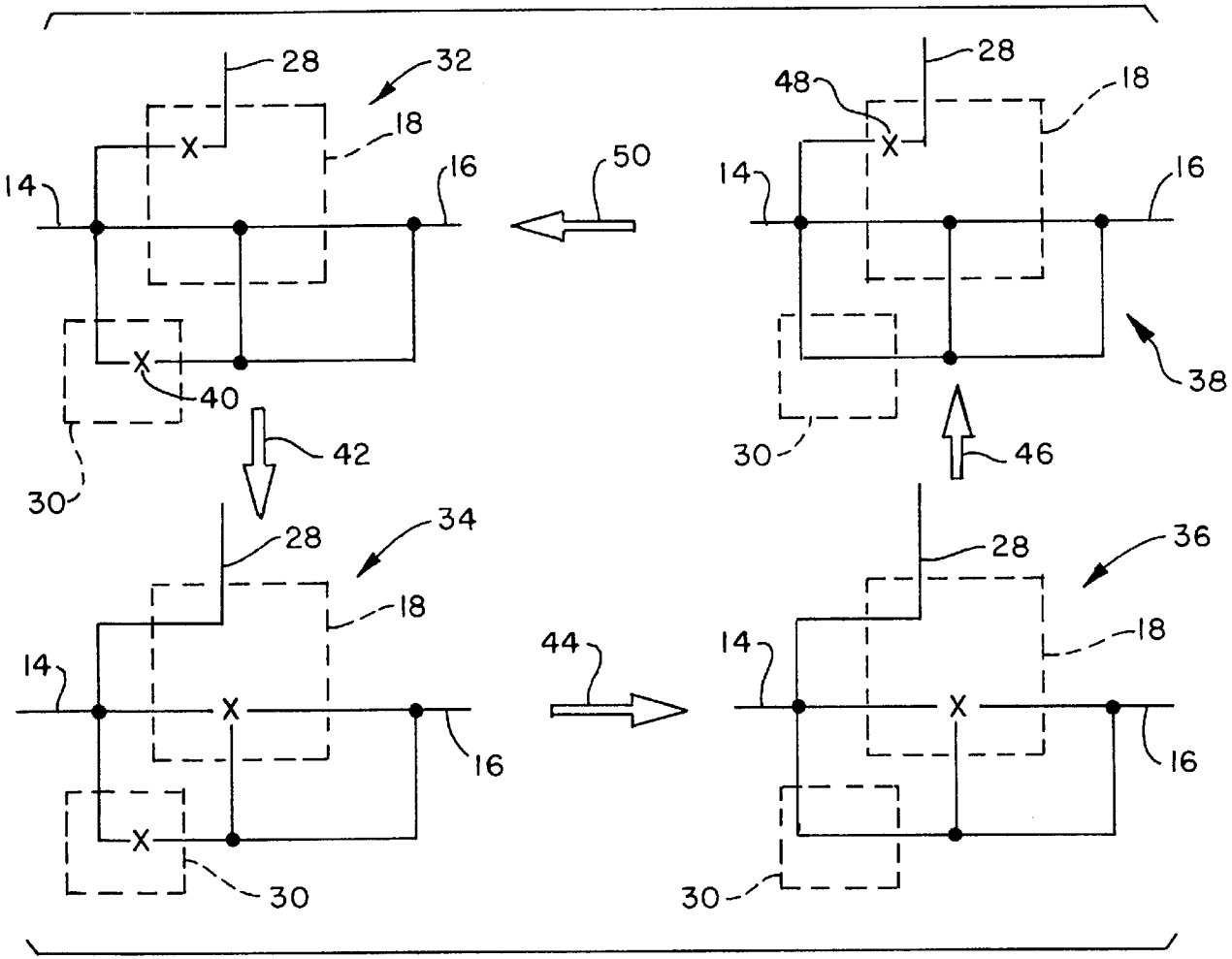
FIG. 3 is a group of simplified line drawings showing the operation of the apparatus of FIG. 1.

Referring now also to FIG. 3, the operation of valve 10 is as follows. FIG. 3 shows the fluid paths corresponding to a NORMAL condition or suction state 32, an INLET BLOCKED state 34, an INITIAL RESET state 36 and a FINAL RESET state 38.

Operation of the valve 10 is in the NORMAL suction state 32 during unobstructed operation at which time fluid communication is maintained between inlet port 14 and outlet port 16, and fluid communication is blocked between inlet port 14 and vent port 28. Reset valve 30 does not permit fluid communication from the inlet port 14 to the actuator chamber 18 during NORMAL suction state 32 (indicated by the "X" 40 in reset valve block 30).

When an obstruction blocks the suction connection upstream of the inlet port 14, operation of the valve 10 shifts from the NORMAL state 32 to the INLET BLOCKED state 34, indicated by arrow 42. While in the INLET BLOCKED state 34, fluid communication is blocked between inlet port 14 and outlet port 16. In this state, fluid communication is established between inlet port 14 and vent port 28, thus relieving any residual suction that may be present upstream of inlet port 14. It is to be understood that vent port 28 is open to ambient air and thus will release any obstruction at the suction connection in the pool. In the INLET BLOCKED state 34, fluid communication between the inlet port 14 through the reset valve 30 to the actuator chamber 18 is also blocked.

When it is desired to resume normal (suction) operation, the reset valve 30 is activated (preferably manually as will be described in more detail below), moving (as indicated by arrow 44) to the INITIAL RESET state or condition 36. In this state, fluid communication between inlet port 14 and outlet port 16 remains blocked, while the fluid communication between inlet port 14 and vent port 28 remains established. When actuated as shown in state 36, the reset valve 30 establishes fluid communication between the inlet port 14 and the actuator chamber 18 via a fluid path 72 connected to the outlet port 16, for reasons which will be explained below.

Upon continued actuation of the reset valve 30, operation of the suction relief valve 10 will progress to the FINAL RESET state 38, indicated by arrow 46. In state or condition 38, the reset valve remains actuated (maintaining the fluid communication between inlet port 14 and actuator chamber 18), and fluid communication between inlet port 14 and outlet port 16 is reestablished, while fluid communication between inlet port 14 and vent port 28 is blocked, as indicated by the "X" 48.

Once the fluid communication between inlet port 14 and outlet port 16 is reestablished, the reset valve 30 is deactuated, resulting in transfer (indicated by arrow 50) to the NORMAL operation or state 32. Reset valve 30 thus may be seen to have a closed condition blocking fluid communication and an open condition permitting fluid communication such that the actuator member 20 is released from the second position 24 when the reset valve 30 is opened.

Figure 4:
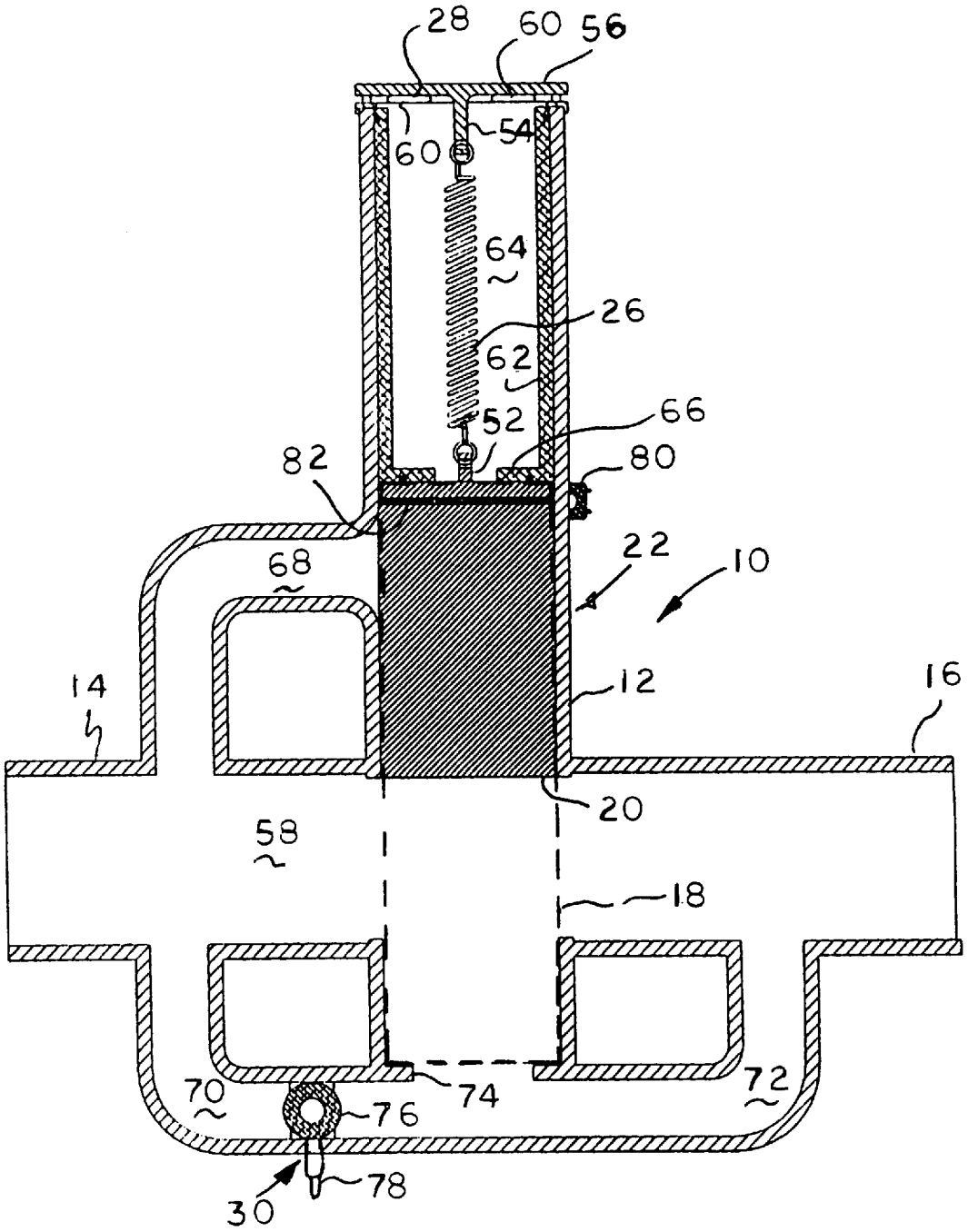
FIG. 4 is a simplified section view of a suction valve useful in the practice of the present invention with parts shown in a NORMAL suction state.
Figure 5:
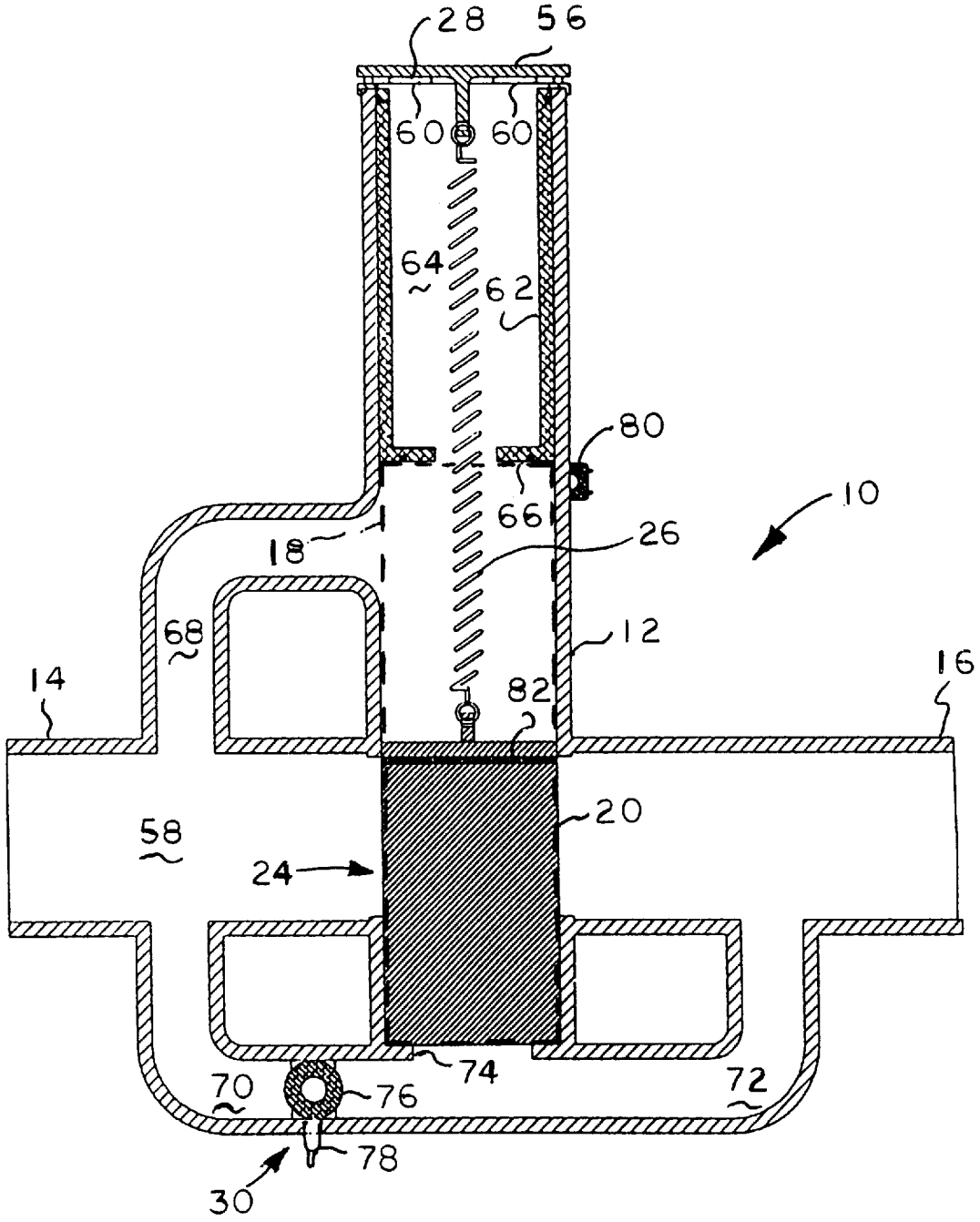
FIG. 5 is a view similar to that of FIG. 3, except with parts shown in an INLET BLOCKED state.

Referring now most particularly to FIGS. 4–7, one embodiment of the suction relief valve 10 is shown in section. Valve housing 12 is preferably molded of polyvinylchloride (PVC) plastic with suitable fittings or means of attachment at inlet and outlet ports 14, 16 to 1½ inch or 2 inch (internal diameter) PVC pipe commonly used in swimming pool and spa installations. The housing is preferably built to conform to Schedule 80 pipe specifications. A movable plug or core, also preferably of PVC, serves as actuator member 20 and is located in the actuator chamber 18. A spring 26 is connected between a boss 52 on core 20 and a boss or hook 54 on a cap 56 and urges core 20 to the first position 22. Housing 12 preferably has a main passageway 58 providing fluid communication between inlet port 14 and outlet port 16. It is to be understood that passageway 58 passes through chamber 18 such that plug 20 will block fluid communication between inlet port 14 and outlet port 16 when the actuator member or plug 20 is in the second position 24, as shown in FIG. 5.

Cap 56 preferably has apertures 60 therein to provide the vent port 28. A spacer 62 may be installed in bore 64 to provide a stop 66 to hold core 20 in the first position 22. Alternatively, stop 66 may be formed integral with housing 12.

Housing 12 also has additional fluid passageways as follows. A passageway 68 is connected between inlet port 14 and actuator chamber 18 such that the passageway 68 is blocked when the actuator member 20 is in the first position 22 and passageway 68 is open for fluid communication to vent port 28 (via chamber 18 and bore 64) when actuator member 20 is in the second position 24. Another passageway 70 is connected between inlet port 14 and reset valve 30. Still another passageway or fluid path 72 is connected between outlet port 16 and actuator chamber 18 at a main valve lock-in port 74.

Figure 6:
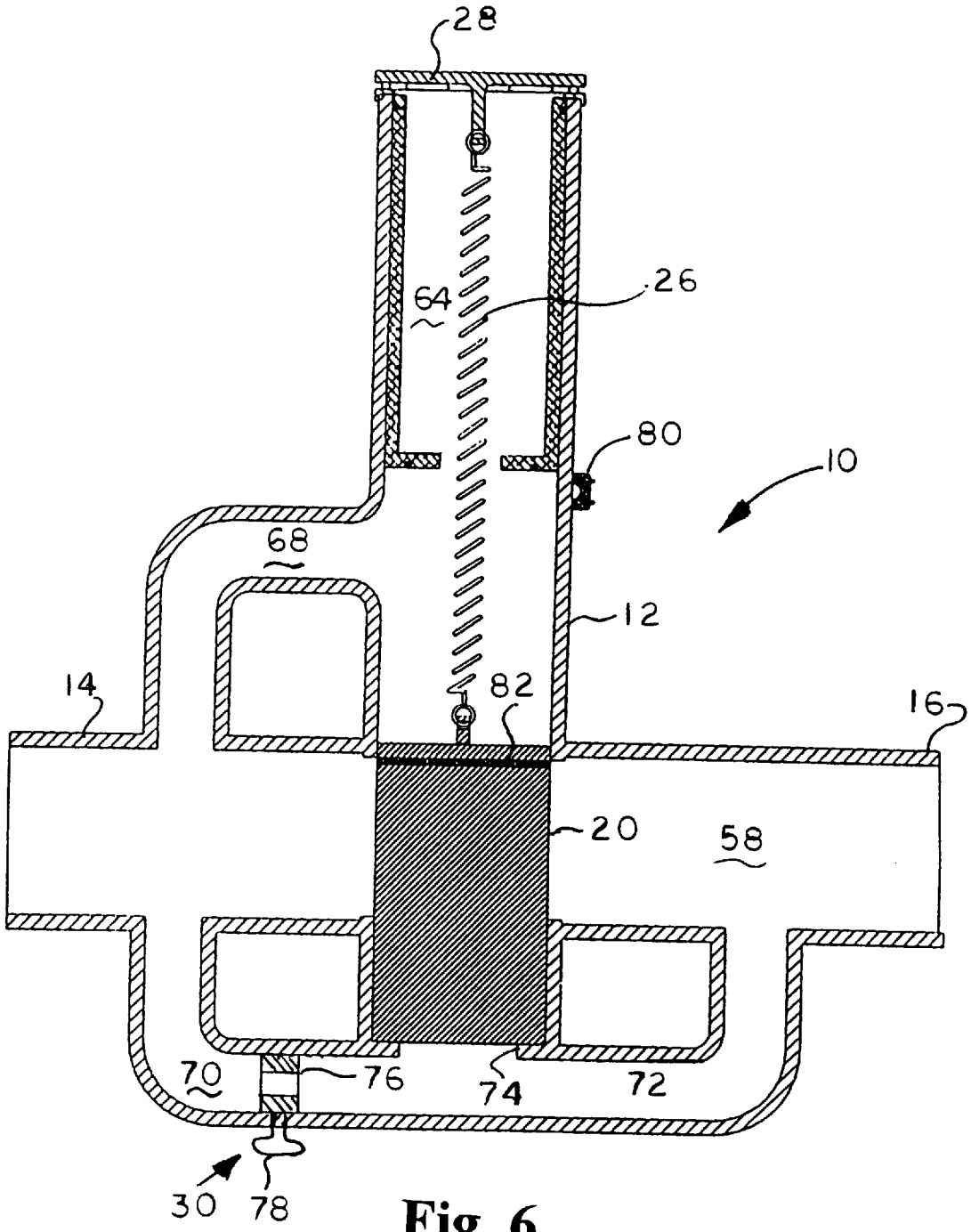
FIG. 6 is a view similar to that of FIG. 4 except with parts shown in an INITIAL RESET state.
Figure 7:
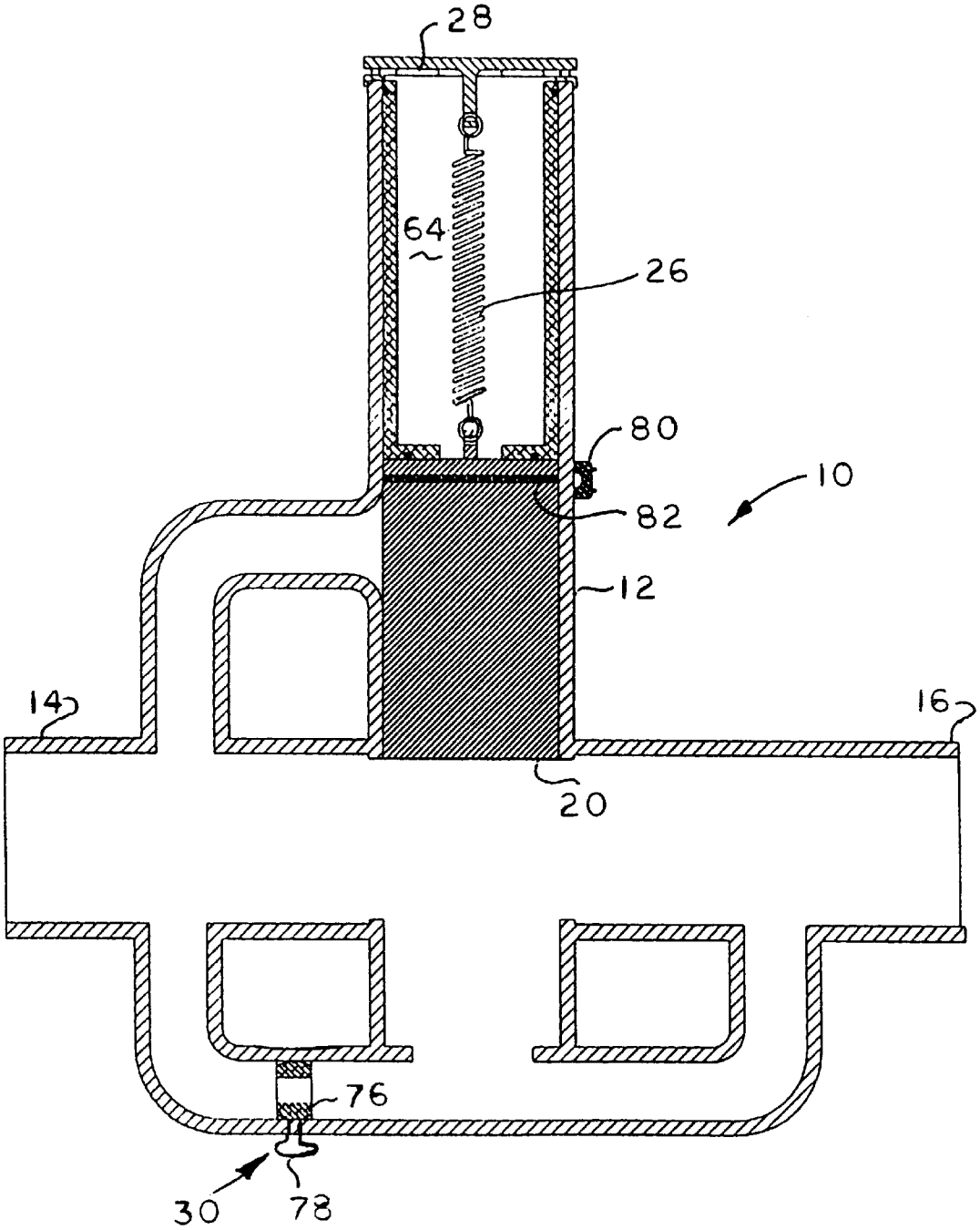
FIG. 7 is a view similar to that of FIG. 5 except with parts shown in a FINAL RESET state.

The reset valve 30 has an internal member 76 movable between a blocking position shown in FIGS. 4 and 5 and a flow-through position shown in FIGS. 6 and 7. The internal member 76 is controllable via an external handle 78. It is to be understood that in the position shown in FIGS. 6 and 7, valve 30 is in an "actuated" condition and permits fluid communication through the valve while actuated.

A magnetically operated switch 80, such as a reed switch, is mounted on the housing 12 adjacent one of the first and second positions 22, 24 of the actuator member 20, preferably adjacent the first position 22, as shown in FIGS. 4–7. A magnetically actuating element 82 is carried by member or core 20 to actuate switch 80 to one of two states, with each state of switch corresponding to one of the positions 22, 24 of the core 20. For example, switch 80 may be a normally-closed type with element 82 adjacent switch 80 (member 20 in the first position 22). When member 20 moves away from the first position 22, switch 80 will then open and remain open, indicating actuator member 20 has moved to the second position. It is to be understood that the magnet for the switch 80 and element 82 may be located on the housing 12 or on the member 20, as desired, provided that switch 80 changes state in response to the movement of member 20.

The operation of valve 10 is as follows. When no restriction or obstruction is present, valve 10 is in the NORMAL condition 32, and liquid flows from the inlet port 14 to the outlet port 16, with no venting via vent port 28, since the core 20 blocks fluid communication between passageway 68 and bore 64.

When an obstruction is present upstream of the inlet port 14 (for example at the suction connection in a pool) the suction force within valve housing 12 will increase, causing actuator member 20 to move from the first position 22 (as shown in FIG. 4) toward the second position 24 (shown in FIG. 5). Once member 20 moves far enough to open the passageway 68 to the bore 64, any suction remaining at the inlet port 14 will be relieved because the inlet port 14 is now vented to ambient air via vent port 28. Because of passageway 72, the suction at the outlet port 16 will be presented at lock-in port 74 to hold member 20 in the second position 24, even after the obstruction is released. The valve 10 is now in the INLET BLOCKED condition 34.

To reset the valve 10, reset valve 30 is actuated, moving member 76 from the blocking condition shown in FIG. 5 to the flow-permitting condition shown in FIG. 6, which corresponds to the INITIAL RESET state or condition 36. This will couple the air and liquid present at inlet port 14 to the lock-in port 74, releasing member 20. Member 20 will then be retracted by spring 26 to the first position 22, as shown in FIG. 7, which corresponds to the FINAL RESET state 38. The handle 78 of reset valve 30 is then returned to the condition shown in FIG. 4 to reestablish the NORMAL operating condition 32.

Figure 8:
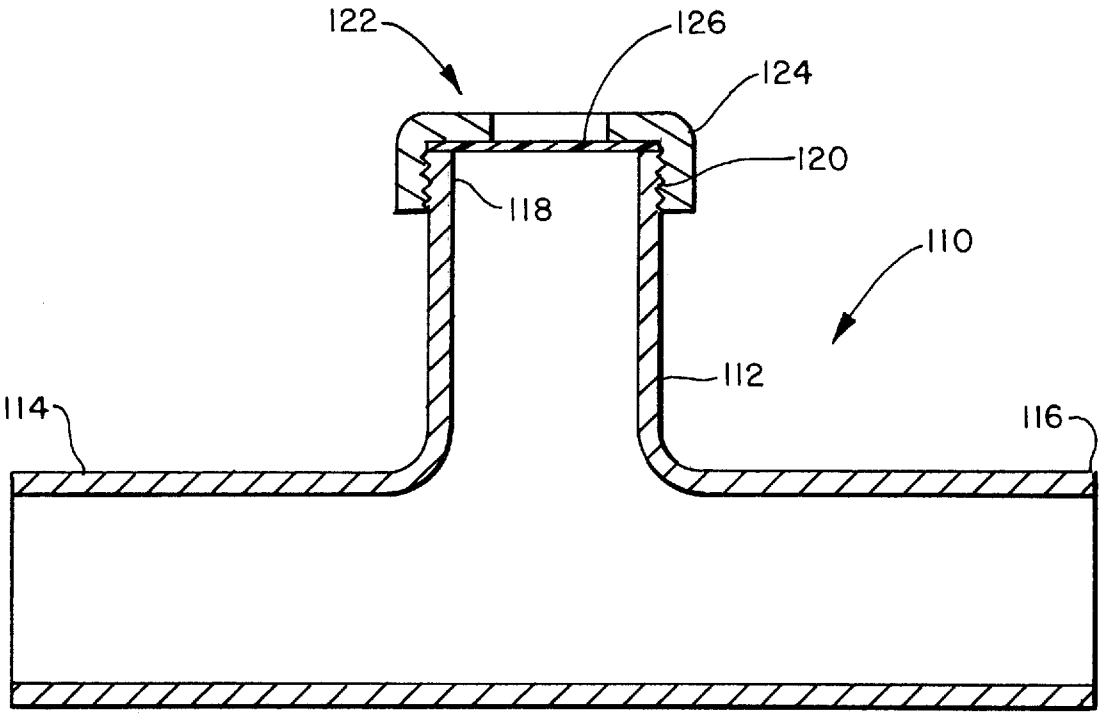
FIG. 8 is an alternative embodiment for the main valve of the present invention.

Referring now to FIG. 8, an alternative embodiment of the present invention may be seen. In this embodiment, a "Tee" or other convenient fitting 110 is preferably connected in the recirculating water path of the pool with a frangible or breakable sealing element connected between the suction line and atmosphere. Fitting 110 has a main body portion 112, an inlet port 114, an outlet port 116, and a vent port 118. In the embodiment shown, main body portion 112 may be made of PVC, with inlet and outlet ports 114, 116 sized and shaped to mate appropriately with the suction side of the recirculating water piping of the pool. Vent port 118 preferably has external threads 120 and is closed by a cap 122 having an annular collar 124 and a frangible or breakable thin disk 126. Although not shown, cap 122 and disk 126 may be unitary and the thin disk 126 (or frangible portion of a unitary design) may be scored or otherwise intentionally weakened to set the suction level at which it will rupture. In operation, the disk 126 is designed to withstand normal suction variations, blocking connection to ambient air atmosphere, and to rupture when an obstruction blocks the suction connection in the pool upstream of the fitting 110, raising the suction above a predetermined level. Once ruptured, disk 126 will admit ambient air into the suction line to which fitting 110 is connected, thus breaking or relieving the suction at the suction connection. It is to be understood that in this embodiment, the disk 126 (or other frangible member) is permanently destroyed and must be replaced with a new disk to resume normal operation. Such an embodiment provides a positive record of the occurrence of an obstruction and will discourage repeated intentional "tripping" of the suction relief apparatus, in addition to being of low initial cost and complexity. Disk 126 is installed by removing collar 124, removing any ruptured disk 126 present, and then installing a new unruptured disk 126 and replacing collar 124 with sufficient seating force to make the connection between disk 126 and the vent port 118 of body portion 112 air tight.

Figure 9:
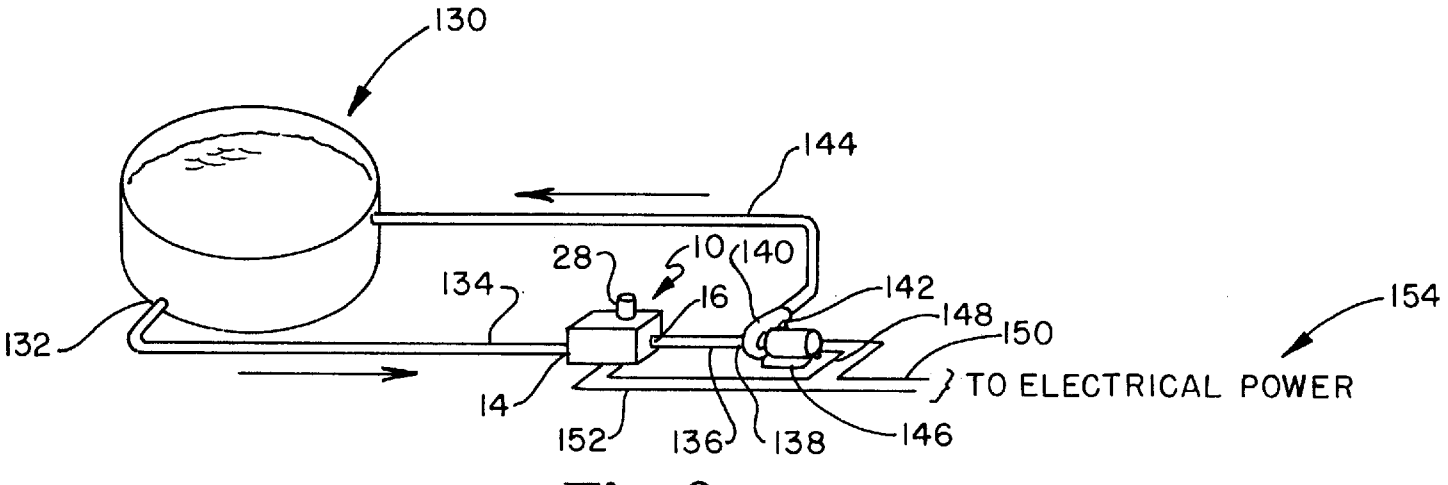
FIG. 9 is a simplified perspective view of the suction relief apparatus including a pool and recirculating pump and motor.
Figure 10:
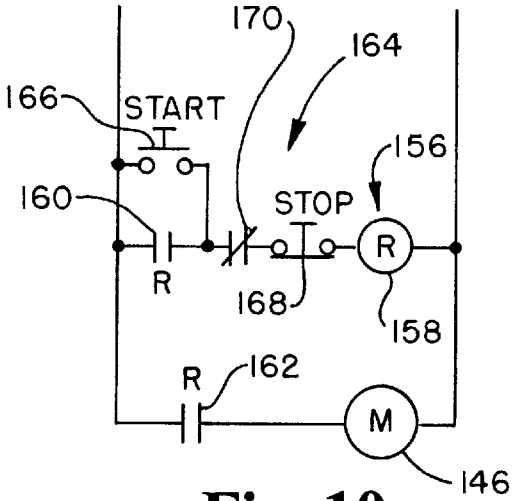
FIG. 10 is a simplified electrical schematic for an electrical system useful with the apparatus of FIG. 9.

Referring now to FIG. 9 an overall simplified perspective view of the suction relief apparatus made up of a pool, pump and motor may be seen. In addition, FIG. 10 illustrates a simplified electrical schematic for an electrical system useful therewith. In FIG. 9, a pool 130 has a suction connection 132 connected thereto, typically at a low elevation in the side (or in the bottom) of the pool. The suction connection 132 is connected to the inlet port 14 of the housing 12 of the suction relief valve 10 via a recirculating water suction line or pipe 134. It is to be understood that the actuator member 20 of relief valve 10 is operative to discontinue suction at the pool 130 when an obstruction blocks the suction connection in the pool. A pump suction line or pipe 136 connects the outlet port 16 to a suction inlet 138 of a suction pump 140. Pump 140 has a discharge connection 142 connected to a recirculating water return line or pipe 144. Pump 140 is driven by an electric motor 146, powered via electrical wires or lines 148 and 150 which may have a single pole single throw normally closed switch 80 connected in series therewith. In such an arrangement, an additional electrical wire or line 152 connects to a source of electrical power 154. It is to be understood that switch 80 is electrically connected to motor 146 and operable by the actuator member 20 to enable delivery of electrical power to the motor 146 when the actuator member 20 is in the first position 22, and switch 80 will disable delivery of electrical power to the motor 146 when the actuator member 20 is in the second position 24. Thus valve 10 is one form of an obstruction sensing means for sensing an obstruction in the suction line 134 in the pool 130, and switch 80, since it is operatively connected to motor 146 driving pump 140, is responsive to the obstruction sensing means to remove power from the motor 146 when an obstruction is sensed. Another way of viewing valve 10 is that it is a differential suction sensor operative to open the electrical switch 80 when suction increases in the suction line 134 from the pool 130.

Referring most particularly to FIG. 10, it may be preferable to switch electrical power to the motor 146 using a relay 156. Relay 156 preferably has a coil 158 and a pair of independent normally-open contacts 160 and 162. Contact 160 is used to hold the circuit 164 ON after the START momentary-contact pushbutton 166 is pressed and released. Contact 162, which is in series with motor 146, will then close, delivering electrical power to the motor 146. Circuit 164 will remain energized until a STOP momentary-break pushbutton 168 is pressed or the normallyclosed contact 170 (in switch 80) opens in response to an obstruction at the suction connection 132 in the pool 130. If either contact 170 or button 168 opens, contact 162 will open and remove power from the motor 146 because relay 156 will be deenergized. Once the obstruction is removed, contact 170 will be permitted to return to its normallyclosed condition, enabling resumption of NORMAL operation.

From the above it can be seen that the present invention encompasses a method of relieving suction in the event of an obstruction in a suction connection 132 to a pool 130 having a recirculating water path (in lines 134, 136 and 144). The method includes sensing the suction level in the recirculating water path and interrupting the flow of recirculation water from the pool to relieve the force holding the obstruction against the suction connection 132 in the pool 130. The method may also include venting the suction connection to ambient air atmosphere. In the practice of the venting, a frangible sealing element 126 may be connected between the suction line 134, 136 and ambient air atmosphere. The recirculating water flow may be interrupted by moving an actuator member 20 in a suction relief valve 10 to block the flow of recirculating water when a predetermined increase in the differential pressure across the valve 10 is sensed, and alternatively (or in addition) an electrical switch 80 may be operated to interrupt the flow by removing power from the motor 146 in response to sensing the predetermined increase in the suction of the recirculating water indicative of an obstruction at the suction connection 132.

The invention is not to be taken as limited to all of the details thereof as modifications and variations thereof may be made without departing from the spirit or scope of the invention. For example, the reset valve 30 may be remotely actuated using a conventional mechanical or electrical actuation means, if desired. Furthermore, an alternative electrical system to that shown as circuit 164 may be utilized; for example, the motor 146 may be switched directly by contact 170 of switch 80, provided the electrical ratings are compatible. Alternatively, other interlocks and or sensors may be included in circuit 164 without departing from the spirit or scope of the present invention.

What is claimed is:

1. A suction relief apparatus for relieving suction at a suction connection to a pool comprising:

a) a main valve housing having
   i) an inlet port,
   ii) an outlet port in fluid communication with the inlet port, and
   iii) an actuator chamber in fluid communication with and located between the inlet port and the outlet port;

b) a main valve actuator member movable between a first position permitting fluid communication between the inlet port and the outlet port, and a second position wherein the actuator member blocks fluid communication between the inlet port and the outlet port; and c) biasing means for urging the main valve actuator member to the first position in the absence of a pressure differential between the outlet port and the inlet port wherein the actuator member moves to the second position in response to a pressure differential between the outlet port and the inlet port caused by a blockage upstream of the inlet port and relieves the suction at the suction connection.

2. The suction relief apparatus of claim 1 wherein the housing further comprises a vent port in fluid communication with the actuator chamber and selectively connectable for fluid communication with the inlet port when the actuator member is in the second position to vent the inlet port to ambient atmospheric pressure.

3. The suction relief apparatus of claim 1 wherein the housing further comprises a fluid path between the outlet port and the actuator chamber operative to retain the actuator member in the second position in response to suction at the outlet port.

4. The suction relief apparatus of claim 3 further comprising a manually operable reset valve connected between the inlet port and the fluid path between the outlet port and the actuator chamber and wherein the reset valve has a closed condition blocking fluid communication and an open condition permitting fluid communication such that the actuator member is released from the second position when the reset valve is opened.

5. The suction relief apparatus of claim 1 wherein the actuator member comprises a movable core.

6. The suction relief apparatus of claim 1 further comprising a suction pump connected to the outlet port of the main valve housing.

7. The suction relief apparatus of claim 6 further comprising an electric motor connected to the suction pump.

8. The suction relief apparatus of claim 7 further comprising an electrical switch electrically connected to the motor and operable by the actuator member to i) enable delivery of electrical power to the motor when the actuator member is in the first position, and ii) disable delivery of electrical power to the motor when the actuator member is in the second position.

9. The suction relief apparatus of claim 1 further comprising a pool and wherein the inlet port of the housing is connected to a suction connection of the pool and the actuator member is operative to discontinue suction at the pool when an obstruction blocks the suction connection in the pool.

* * * * *